US011376876B2

(12) United States Patent
Yamada et al.

(10) Patent No.: US 11,376,876 B2
(45) Date of Patent: Jul. 5, 2022

(54) PRINTING APPARATUS AND METHOD OF PRINTING

(71) Applicant: SEIKO EPSON CORPORATION, Tokyo (JP)

(72) Inventors: Jun Yamada, Matsumoto (JP); Atsushi Imamura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 172 days.

(21) Appl. No.: 16/835,595

(22) Filed: Mar. 31, 2020

(65) Prior Publication Data

US 2020/0307278 A1 Oct. 1, 2020

(30) Foreign Application Priority Data

Apr. 1, 2019 (JP) ..... JP2019-069696

(51) Int. Cl.

| | |
|---|---|
| ***B41J 15/04*** | (2006.01) |
| ***B65H 18/14*** | (2006.01) |
| ***B65H 26/08*** | (2006.01) |
| ***B65H 23/18*** | (2006.01) |
| ***B65H 23/00*** | (2006.01) |
| ***B65H 26/02*** | (2006.01) |

(52) U.S. Cl.

CPC ..... *B41J 15/048* (2013.01); *B65H 18/145* (2013.01); *B65H 23/005* (2013.01); *B65H 23/1813* (2013.01); *B65H 26/02* (2013.01); *B65H 26/08* (2013.01)

(58) Field of Classification Search

CPC .... B41J 15/048; B65H 18/145; B65H 23/005; B65H 23/1813; B65H 26/02; B65H 26/08

See application file for complete search history.

(56) References Cited

U.S. PATENT DOCUMENTS

| | | | | |
|---|---|---|---|---|
| 5,745,217 | A * | 4/1998 | Factor | G03B 27/521 355/40 |
| 2009/0088889 | A1* | 4/2009 | Hellstrom | D21G 9/0009 700/127 |
| 2015/0346106 | A1* | 12/2015 | Eder | G01N 21/89 702/81 |
| 2018/0284037 | A1* | 10/2018 | Kashu | G01N 23/18 |

FOREIGN PATENT DOCUMENTS

| | | |
|---|---|---|
| JP | 2017-170817 | 9/2017 |

* cited by examiner

*Primary Examiner* — Sang K Kim

(74) *Attorney, Agent, or Firm* — Workman Nydegger

(57) ABSTRACT

A printing apparatus (printer) is provided in which a base material is conveyed by a roll-to-roll method and feedback control is performed on a tension imposed on the base material, and which includes a control unit, a first drive motor (front drive motor) configured to control a speed of conveyance of conveying the base material, and a second drive motor (feeding motor, rear drive motor, winding motor) configured to control the tension imposed on the base material. In a case where a conveyance operation for conveying the base material is stopped based on detection of a foreign object, and when a speed of the first drive motor is at a predetermined value or less, the control unit stops the tension control performed by the second drive motor.

6 Claims, 7 Drawing Sheets

PRINTING APPARATUS AND METHOD OF PRINTING

The present application is based on, and claims priority from JP Application Serial Number 2019-069696, filed Apr. 1, 2019, the disclosure of which is hereby incorporated by reference herein in its entirety.

BACKGROUND

1. Technical Field

The present disclosure relates to a printing apparatus and a printing method.

2. Related Art

Hitherto, a roll-to-roll type printing apparatus has a specification for stopping a conveyance operation before a foreign object is conveyed at a position of a printing head and damages the printing head in a case where a sensor detects the foreign object in a base material during conveyance (hereinafter, such stop is referred to as an emergency stop). In this case, the printing apparatus controls a tension, which is imposed on a stopped base material, to be a predetermined tension (JP-A-2017-170817).

However, in recent years, a printing apparatus has increased a printing speed. When an emergency stop is performed in such printing apparatus, it is required to stop the base material with a conveyance distance equivalent to that in the related art. In order to achieve this, it is required to increase deceleration more than that in the related art. Further, when tension control similar to that in the related art is performed for an emergency stop while increasing a printing speed, there arises a problem in that slack or tension is caused to a base material at a feeding shaft or a winding shaft more than that in the related art and sudden tension fluctuation is caused.

SUMMARY

A printing apparatus according to the present application is a printing apparatus in which a base material is conveyed by a roll-to-roll method and feedback control is performed on a tension imposed on the base material, the printing apparatus includes a control unit, a first drive motor configured to control a speed of conveyance of conveying the base material, and a second drive motor configured to control the tension imposed on the base material, wherein, in a case where a conveyance operation for conveying the base material is stopped based on detection of a foreign object, and when a speed of the first drive motor is at a predetermined value or less, the control unit stops the tension control performed by the second drive motor.

In the printing device described above, in a case where the conveyance operation is stopped based on the detection of a foreign object, and the control unit may start the tension control performed by the second drive motor after a passage of a predetermined time period.

The printing device described above may include a roll diameter sensor configured to detect a roll diameter of the base material wound in a roll shape, and the control unit may vary an inertia of the base material in accordance with a detection value of the roll diameter sensor, and control the first drive motor in a case where the conveyance operation is stopped based on the detection of a foreign object.

A printing method according to the present application is a printing method of a printing apparatus in which a base material is conveyed by a roll-to-roll method and feedback control is performed on a tension imposed on the base material, and which includes a control unit, a first drive motor configured to control a speed of conveyance of conveying the base material, and a second drive motor configured to control the tension imposed on the base material. The printing method includes a tension control stopping step for, in a case where a conveyance operation for conveying the base material is stopped based on detection of a foreign object, and when a speed of the first drive motor is at a predetermined value or less, stopping, by the control unit, the tension control performed by the second drive motor.

The printing method described above may include a tension control step for, after completing the tension control stopping step based on the detection of a foreign object, starting, by the control unit, the tension control performed by the second drive motor after a passage of a predetermined time period.

In the printing method described above, a roll diameter sensor configured to detect a roll diameter of the base material wound in a roll shape may be provided, and the method may include an inertia control step for, by the control unit, varing an inertia of the base material in accordance with a detection value of the roll diameter sensor, and controlling the first drive motor in a case where the conveyance operation is stopped based on the detection of a foreign object.

DESCRIPTION OF EXEMPLARY EMBODIMENTS

First Exemplary Embodiment

An outline of a printing apparatus according to an exemplary embodiment of the present disclosure will be described with reference to the drawings. In the exemplary embodiment, the printing apparatus is a printing apparatus that conveys a base material in a roll-to-roll method. As one example of this, description is given with a line type ink jet printer 1 (hereinafter, simply referred to as a printer 1).

A device configuration of the printer 1 according to the exemplary embodiment will be described.

Figure 1:
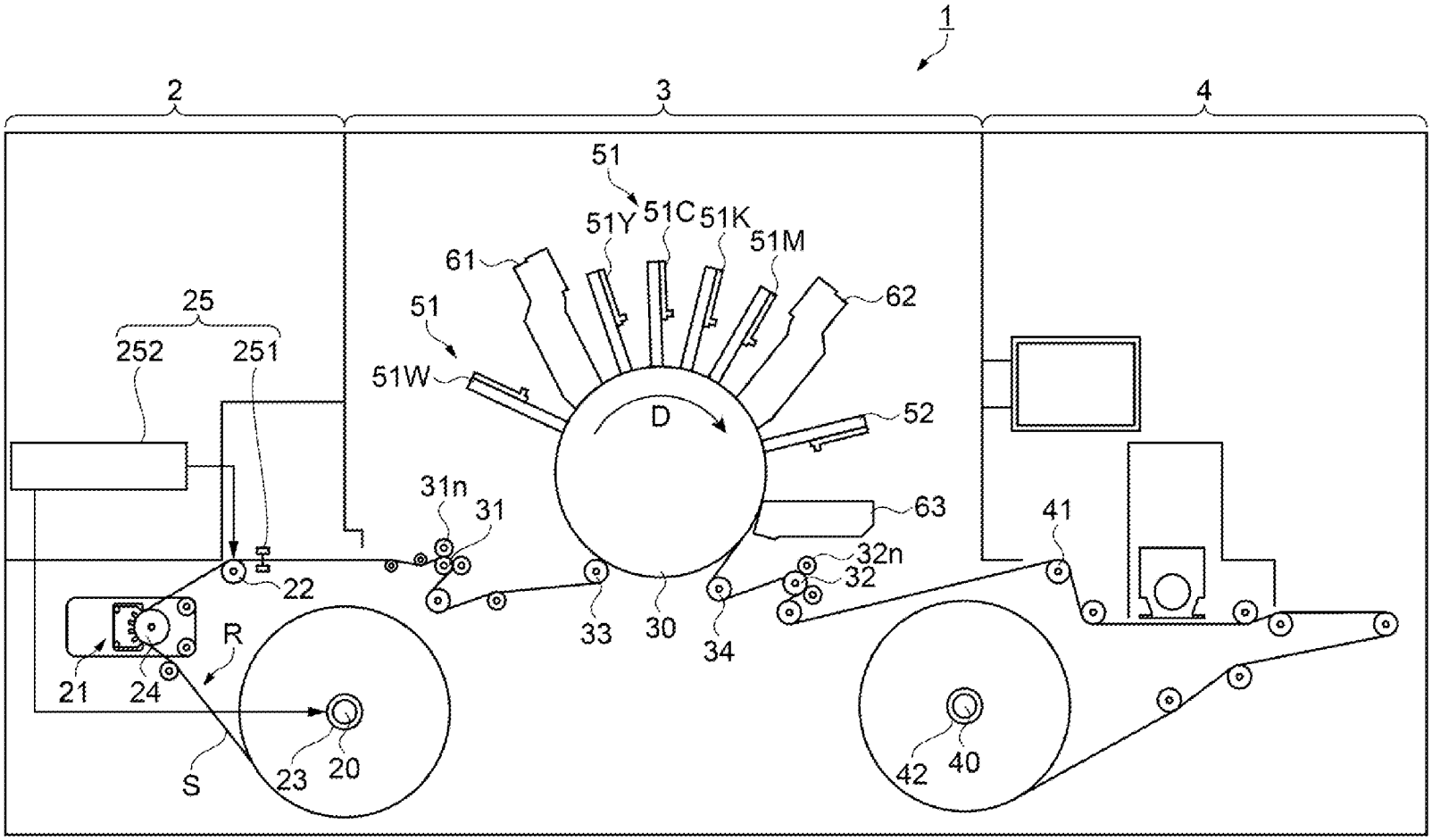
FIG. 1 is a front view schematically illustrating a device configuration of a printer according to a first exemplary embodiment.

FIG. 1 is a front view schematically illustrating a configuration of the printer 1 according to the first exemplary embodiment.

As illustrated in FIG. 1, in the printer 1, one base material S is stretched along a conveyance path R, and has both edges wound around a feeding shaft 20 and a winding shaft 40 in a roll shape. The base material S is subjected to printing while being conveyed in a conveyance direction D directed from the feeding shaft 20 to the winding shaft 40. Note that the base material S sequentially passes through rollers described later, and thus the conveyance path R for conveying the base material S is formed.

Types of the base material S are broadly divided into a paper-based type and a film-based type. Specific examples of the paper type include high-quality paper, cast paper, art paper, coated paper, and the like, and specific examples of the film type include synthetic paper, polyethylene terephthalate (PET), polypropylene (PP), and the like.

As a schematic configuration, the printer 1 includes a feeding section 2 (feeding area) for feeding the base material S from the feeding shaft 20, a process section 3 (process area) for recording an image on the base material S fed from the feeding section 2, and a winding section 4 (winding area) for winding, around the winding shaft 40, the base material S on which the image has been recorded in the process section 3. Note that, in the following description, of both surfaces of the base material S, the surface on which the image is recorded will be referred to as a front surface, and the reverse side surface will be referred to as a back surface.

The feeding section 2 includes the feeding shaft 20 around which the edge of the base material S is wound, a corona treatment machine 21 being a pre-process unit that performs processing for modifying the front surface of the base material S drawn from the feeding shaft 20, and a tension roller 22 (driven roller). Note that the corona treatment machine 21 being a pre-process unit is arranged upstream of printing units (printing heads 51 and 52) described later in the conveyance path R for the base material S.

The feeding shaft 20 supports the base material S by winding the edge thereof with the front surface of the base material S facing outward. In addition, when the feeding shaft 20 is rotated clockwise in FIG. 1, the base material S wound around the feeding shaft 20 is fed to the process section 3 via the pre-process unit (corona treatment machine 21) and the tension roller 22.

The base material S is wound around the feeding shaft 20 through intermediation of a core pipe 23 that is detachable from the feeding shaft 20. Thus, when the base material S around the feeding shaft 20 is used up, it is possible to attach, to the feeding shaft 20, a new core pipe 23 around which the rolled base material S has been wound and replace the base material S around the feeding shaft 20.

The corona treatment machine 21 being a pre-process unit subjects the front surface being a printing surface of the base material S to be conveyed to corona discharge irradiation. With this, front surface processing for modifying the front surface is performed, and wettability of ink at the time pf printing is improved. This is performed mainly when the base material S is a film type. Hereinafter, performing corona discharge irradiation is referred to as corona treatment. Note that, in the feeding section 2, the corona treatment machine 21 includes a conveying shaft 24 for conveying the base material S.

The feeding shaft 20, the conveying shaft 24, and the tension roller 22 are configured so as to be movable in a width direction (a direction vertical to the drawing sheet of FIG. 1) orthogonal to the conveyance direction D. The feeding section 2 adjusts positions of the feeding shaft 20, the conveying shaft 24, and the tension roller 22 in the width direction (shaft direction), and thus forms a steering mechanism 25 for suppressing meandering of the base material S.

The steering mechanism 25 includes an edge sensor 251 and a width-direction drive unit 252. The edge sensor 251 is provided downstream of the tension roller 22 in the conveyance direction D so as to face an edge portion of the base material S in the width direction, and detects a position of an edge of the base material S in the width direction. Further, the width-direction drive unit 252 moves the feeding shaft 20, the conveying shaft 24, and the tension roller 22 in the width direction in accordance with a detection result of the edge sensor 251. In this manner, meandering of the base material S is suppressed.

Note that, in the exemplary embodiment, in order to form the steering mechanism 25, the feeding shaft 20, the conveying shaft 24, and the tension roller 22 are formed as an integrated block through use of a fixing member (not shown), and are incorporated in the printer 1. In this block, with the fixing member as a reference, the feeding shaft 20 and the tension roller 22 are subjected to alignment adjustment by screw fastening to be fixed.

While supporting the base material S, which is fed from the feeding section 2, with a platen drum 30, the process section 3 performs printing an image on the base material S by performing processing as appropriate with function units 51, 52, 61, 62, and 63 arranged along an outer circumference surface of the platen drum 30. In the process section 3, a front drive roller 31 and a rear drive roller 32 are provided upstream and downstream of the platen drum 30, respectively. Further, from the front drive roller 31 to the rear drive roller 32 along the conveyance direction D, the base material S to be conveyed is supported by the platen drum 30, and is subjected to printing.

The front drive roller 31 has a plurality of minute protrusions, which are formed by thermal spraying on the outer circumferential surface of the front drive roller 31, and the base material S fed from the feeding section 2 is wound from the back surface side of the base material S. In addition, by being rotated clockwise in FIG. 1, the front drive roller 31 conveys the base material S fed from the feeding section 2 downstream in the conveyance direction D. Note that a nip roller 31*n* is provided with respect to the front drive roller 31. This nip roller 31*n* is held in contact with the front surface of the base material S while being biased toward the front drive roller 31, and the base material S is sandwiched between the nip roller 31*n* and the front drive roller 31. With this, a frictional force between the front drive roller 31 and the base material S is secured, and the front drive roller 31 can securely convey the base material S.

The platen drum 30 is, for example, a cylindrical drum having a diameter of 400 mm, which is rotatably supported in both the conveyance direction D and the reverse direction by a support mechanism (not shown). Further, the platen drum 30 wounds the base material S conveyed from the front drive roller 31 to the rear drive roller 32. The platen drum 30 supports the base material S from the back surface side of the base material S while being driven to rotate in the conveyance direction D of the base material S by receiving a frictional force between the platen drum 30 and the base material S.

The process section 3 is provided with a driven roller 33 and a tension roller 34 (driven rollers) that fold back the base material S on both sides of the part at which the base material S is wound on the platen drum 30. The front surface of the base material S is wound on the driven roller 33 between the front drive roller 31 and the platen drum 30 to fold back the base material S. Meanwhile, the front surface of the base material S is wound on the driven roller 34 between the platen drum 30 and the rear drive roller 32 to fold back the base material S. In this manner, by folding back the base material S respectively upstream and downstream of the platen drum 30 in the conveyance direction D, a long length of the part at which the base material S is wound on the platen drum 30 can be secured.

The rear drive roller 32 has a plurality of minute protrusions, which are formed by thermal spraying on the outer circumferential surface of the rear drive roller 32, and the base material S conveyed from the platen drum 30 via the driven roller 34 is wound from the back surface side of the base material S. In addition, by being rotated clockwise in FIG. 1, the rear drive roller 32 conveys the base material S to the winding section 4.

Note that a nip roller 32*n* is provided with respect to the rear drive roller 32. This nip roller 32*n* is held in contact with the front surface of the base material S while being biased toward the rear drive roller 32, and the base material S is sandwiched between the nip roller 32*n* and the rear drive roller 32. With this, a frictional force between the rear drive roller 32 and the base material S is secured, and the rear drive roller 32 can securely convey the base material S.

In this manner, the base material S conveyed from the front drive roller 31 to the rear drive roller 32 is supported by the outer circumferential surface of the platen drum 30. In addition, in the process section 3, in order to print a color image on the front surface of the base material S supported by the platen drum 30, a plurality of line type printing heads 51 corresponding to colors different from one another are provided. Note that the printing heads 51 and a printing head 52 described later form a printing unit together.

As the printing heads 51, in the exemplary embodiment, the five printing heads 51 (51W, 51Y, 51C, 51K, and 51M) corresponding to white, yellow, cyan, black, and magenta are provided in the conveyance direction D in the stated color order. The printing heads 51 faces the front surface of the base material S wound on the platen drum 30 with slight clearance between the printing head 51 and the front surface, and ejects an ink having a corresponding color (colored ink) from a nozzle by an ink jet method. Further, the printing head 51 ejects the ink onto the base material S to be conveyed in the conveyance direction D, and thus a color image is formed on the front surface of the base material S.

Further, as the ink, an ultraviolet (UV) ink (photocurable ink) that is cured by being irradiated with ultraviolet rays (light) is used. Thus, in order to cure and fix the ink onto the base material S, the process section 3 is provided with UV irradiators 61, 62, and 63. Note that this ink curing is performed by separately using two stages of temporary curing and final curing.

The UV irradiator 61 for final curing is arranged downstream of the printing head 51W for white and upstream of the printing head 51Y for yellow. The UV irradiator 61 for final curing performs irradiation with ultraviolet light having high intensity, and cures the ink to such degree that wetting extendability of the ink is stopped (final curing). Meanwhile, the UV irradiator 62 for temporary curing is arranged downstream of the printing head 51Y for yellow, the printing head 51C for cyan, the printing head 51K for black, and the printing head 51M for magenta. The UV irradiator 62 for temporary curing performs irradiation with ultraviolet light having intensity lower than that of the UV irradiator 61, and cures the ink to such extent that wetting extendability of the ink is sufficiently slower than that in a case without irradiation with the ultraviolet light (temporary curing).

The UV irradiator 61 arranged downstream of the printing head 51W for white finally cures the ink for white as described above, and thus wetting extendability of the ink is stopped. Further, the UV irradiator 62 arranged downstream of the printing head 51M for magenta performs temporal curing before the colored ink ejected from the printing heads 51Y, 51C, 51K, and 51M are mixed, and thus color mixing is suppressed. In this manner, a color image is formed on the base material S.

Furthermore, the printing head 52 is provided downstream of the UV irradiator 62 in the conveyance direction D. The printing head 52 faces the front surface of the base material S wound on the platen drum 30 with slight clearance between the printing head 52 and the front surface, and ejects a clear UV ink onto the front surface of the base material S by an ink jet method. With this, the clear ink is further ejected onto the color image formed by the printing heads 51 in five colors. The clear ink is ejected onto the entire color image, and applies texture such as shiny appearance and mat tone appearance to the color image.

Further, the UV irradiator 63 is provided downstream of the printing head 52 in the conveyance direction D. The UV irradiator 63 performs irradiation with intense ultraviolet light, and thus cures the clear ink ejected from the printing head 52 together with the four colored inks, which are ejected from the printing heads 51Y, 51C, 51K, and 51M and temporarily cured. With this, the four colored ink and the clear ink can be fixed onto the front surface of the base material S.

As described above, in the process section 3, ejection and curing of the inks are appropriately performed onto the base material S wound around the outer circumferential portion of the platen drum 30, and thus the color image coated with the clear ink is formed. Further, the base material S on which the color image is formed is conveyed to the winding section 4 by the rear drive roller 32.

In addition to the winding shaft 40 around which the edge of the base material S has been wound, the winding section 4 includes a tension roller 41 (driven roller) for winding the base material S between the winding shaft 40 and the rear drive roller 32 from the back surface side of the base material S. The winding shaft 40 supports the base material S by winding the edge thereof with the front surface of the base material S facing outward. That is, when the winding shaft 40 is rotated clockwise in FIG. 1, the base material S conveyed from the rear drive roller 32 is wound around the winding shaft 40 via the tension roller 41. In this regard, the base material S is wound around the winding shaft 40 via a core pipe 42 that is detachable from the winding shaft 40. Thus, when the base material S wound around the winding shaft 40 becomes full, the base material S can be detached together with the core pipe 42.

Next, an electrical configuration for controlling the printer 1 will be described.

Figure 2:
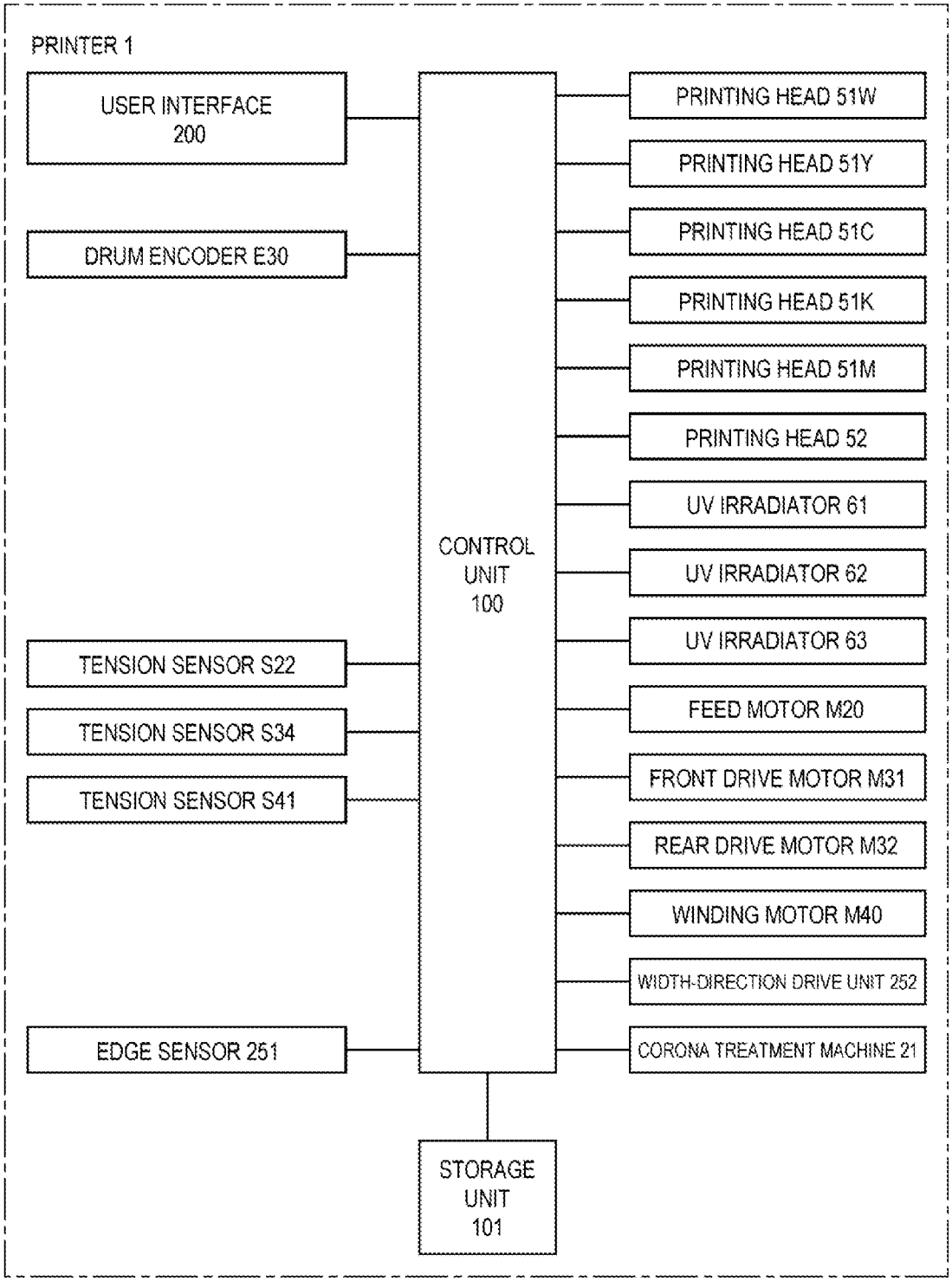
FIG. 2 is a schematic block diagram illustrating an electrical configuration for controlling the printer according to the exemplary embodiment.

FIG. 2 is a schematic block diagram illustrating an electrical configuration for controlling the printer 1 according to the exemplary embodiment.

As illustrated in FIG. 2, the printer 1 includes a control unit 100 that comprehensively controls the respective device units in the apparatus. The control unit 100 is a computer including a Central Processing Unit (CPU) and a Random Access Memory (RAM).

The printer 1 includes the control unit 100 and a user interface 200 that functions as an interface for a user. The user interface 200 is formed of an input device such as a mouse and a keyboard and an output device such as a display device. Therefore, a user can input a desired instruction to the control unit 100 by operating the input device of the user interface 200, and can check an operation state of the printer 1 by checking the output device of the user interface 200. Note that the input device and the output device are necessarily formed as separate bodies, and may be formed integrally as a touch panel display or the like.

Based on an instruction input by a user via the user interface 200 and an instruction received from other external devices, the control unit 100 controls the printing heads 51 and 52, the UV irradiators 61, 62, and 63, the corona treatment machine 21, and the respective device units for conveying the base material.

The control unit 100 controls ink ejection timings of the printing heads 51 for forming a color image in accordance with the conveyance of the base material S. Specifically, the control of the ink ejection timings is performed based on an output (detection value) of a drum encoder E30 that is mounted to a rotary shaft of the platen drum 30 and detects a rotary position of the platen drum 30.

The platen drum 30 is driven to rotate along with conveyance of the base material S, and hence the conveyance position of the base material S can be grasped by referring to the output of the drum encoder E30 that detects the rotary position of the platen drum 30. In view of this, the control unit 100 generates a print timing signal (PTS) from the output of the drum encoder E30, and controls the ink ejection timings of the printing heads 51, based on the PTS signal. With this, the inks ejected from the printing heads 51 are caused to land on target positions on the base material S to be conveyed, and thus a color image is formed.

Further, a timing at which the printing head 52 ejects the clear ink is similarly controlled by the control unit 100, based on the output of the drum encoder E30. With this, the clear ink can be ejected accurately onto the color image formed by the plurality of printing heads 51.

Moreover, the control unit 100 controls timings of on/off states of the UV irradiators 61, 62, and 63 and an irradiation light amount. Further, the control unit 100 controls on/off states and an irradiation light amount of corona irradiation with respect to the corona treatment machine 21, based on an input operation from the user interface 200 by a user.

The control unit 100 has a function of controlling conveyance of the base material S. The control of conveyance of the base material S is achieved mainly with steering control, tension control, and the like of the base material S. The steering control is performed through use of the steering mechanism 25 provided to the feeding section 2. Specifically, the control unit 100 causes the width-direction drive unit 252 to adjust the positions of the feeding shaft 20, the conveying shaft 24, and the tension roller 22 in the width direction in accordance with a detection result of the edge sensor 251, and thus performs feedback control of the position of the base material S in the width direction. Further, the tension control is performed though use of motors describer later, which are connected to the feeding shaft 20, the front drive roller 31, the rear drive roller 32, and the winding shaft 40, among the members for conveying the base material.

With regard to the tension control of the base material S, the control unit 100 rotates a feed motor M20 that drives the feeding shaft 20 by a direct drive method, and thus feeds the base material S from the feeding shaft 20 to the front drive roller 31. In this case, the control unit 100 controls a torque of the feed motor M20, and adjusts a tension (feed tension Ta) of the base material S from the feeding shaft 20 to the front drive roller 31. In other words, the control unit 100 controls a torque of the feed motor M20, and adjusts the feed tension Ta in an area being the feeding section 2.

A tension sensor S22 that detects a magnitude of the feed tension Ta is mounted to the tension roller 22 arranged between the feeding shaft 20 and the front drive roller 31. The tension sensor S22 may be formed of, for example, a load cell that detects a magnitude of a force received from the base material S. Further, the control unit 100 performs feedback control of a torque of the feed motor M20, based on a detection result (detection value) of the tension sensor S22, and adjusts the feed tension Ta of the base material S.

Further, the control unit 100 rotates a front drive motor M31 that drives the front drive roller 31 and a rear drive motor M32 that drives the rear drive roller 32. With this, the base material S fed from the feeding section 2 passes through the process section 3. In this case, speed control is performed to the front drive motor M31 whereas torque control is performed to the rear drive motor M32. Specifically, the control unit 100 performs feedback control of a rotational speed of the front drive motor M31, based on the encoder of the front drive motor M31, and thus adjusts a conveyance speed of the base material S. With this, the base material S is conveyed by the front drive roller 31 at a printing speed set as a conveyance speed of the base material S while performing printing.

Meanwhile, the control unit 100 controls a torque of the rear drive motor M32, and thus adjusts a tension (process tension Tb) of the base material S from the front drive roller 31 to the rear drive roller 32. In other words, the control unit 100 controls a torque of the rear drive motor M32, and adjusts the process tension Tb in an area being the process section 3.

The tension sensor S34 that detects a magnitude of the process tension Tb is mounted to a tension roller 34 arranged between the platen drum 30 and the rear drive roller 32. The tension sensor S34 may be formed of, for example, a load cell that detects a magnitude of a force received from the base material S. Further, the control unit 100 performs feedback control of a torque of the rear drive motor M32, based on a detection result (detection value) of the tension sensor S34, and adjusts the process tension Tb of the base material S.

Further, the control unit 100 rotates a winding motor M40 that drives the winding shaft 40 by a direct drive method, and thus the base material S, which is conveyed by the rear drive roller 32, is wound round the winding shaft 40. In this case, the control unit 100 controls a torque of the winding motor M40, and adjusts a tension (winding tension Tc) of the base material S from the rear drive roller 32 to the winding shaft 40. In other words, the control unit 100 controls a torque of the winding motor M40, and adjusts the winding tension Tc in an area being the winding section 4.

A tension sensor S41 that detects a magnitude of the winding tension Tc is mounted to the tension roller 41 arranged between the rear drive roller 32 and the winding shaft 40. The tension sensor S41 may be formed of, for example, a load cell that detects a magnitude of a force received from the base material S. Further, the control unit 100 performs feedback control of a torque of the winding motor M40, based on a detection result (detection value) of the tension sensor S41, and adjusts the winding tension Tc of the base material S.

Particularly, the control unit 100 adjusts the tensions Ta, Tb. and Tc to printing tensions Ta1, Tb1, and Tc1, respectively, during a conveyance period in which the base material S is conveyed along with a printing operation. Further, the control unit 100 adjusts the tensions Ta, Tb. and Tc to standby tensions Ta2, Tb2, and Tc2, respectively during a standby period in which conveyance of the base material S is stopped without a printing operation.

Here, the standby tensions Ta2, Tb2, and Tc2 are lower than the printing tensions Ta1, Tb1, and Tc1, respectively (Ta2<Ta1, Tb2<Tb1, Tc2<Tc1). Further, the printing tensions Ta1, Tb1, and Tc1 may also be referred to as conveyance tensions required for conveying the base material S appropriately.

As described above, in the exemplary embodiment, feedback control is performed form a rotational speed of the front drive motor M31, and thus a conveyance speed at which the front drive roller 31 conveys the base material S is adjusted. Note that the exemplary embodiment has four types of printing speeds, and the control unit 100 as well as an input instruction by a user can perform setting to any of the printing speeds. In the exemplary embodiment, as the printing speeds, for example, the four types including 7.6 m/min, 15 m/min, 30 m/min, and 50 m/min can be set. Note that the printing speed can also be referred to as a conveyance speed of the base material S while performing printing.

Note that the printer 1 includes a storage unit 101 that stores various pieces of information. The storage unit 101 stores programs describing control procedures for performing the various types of control describe above. Therefore, the control unit 100 reads a required program from the storage unit 101, and performs each of the various types of control described above.

When a sensor for detecting a foreign object (not shown) detects that a foreign object adheres to the front surface of the base material S to be conveyed, the printer 1 is required to perform an emergency stop of the printing operation before the foreign object is conveyed to the positions of the printing heads 51 and damages the printing heads 51. Note that, in the exemplary embodiment, an emergency stop of the printing operation can also be referred to as an emergency stop of the conveyance operation. The exemplary embodiment solves a defect of the printer 1 at the time of an emergency stop of the conveyance operation.

Figure 3:
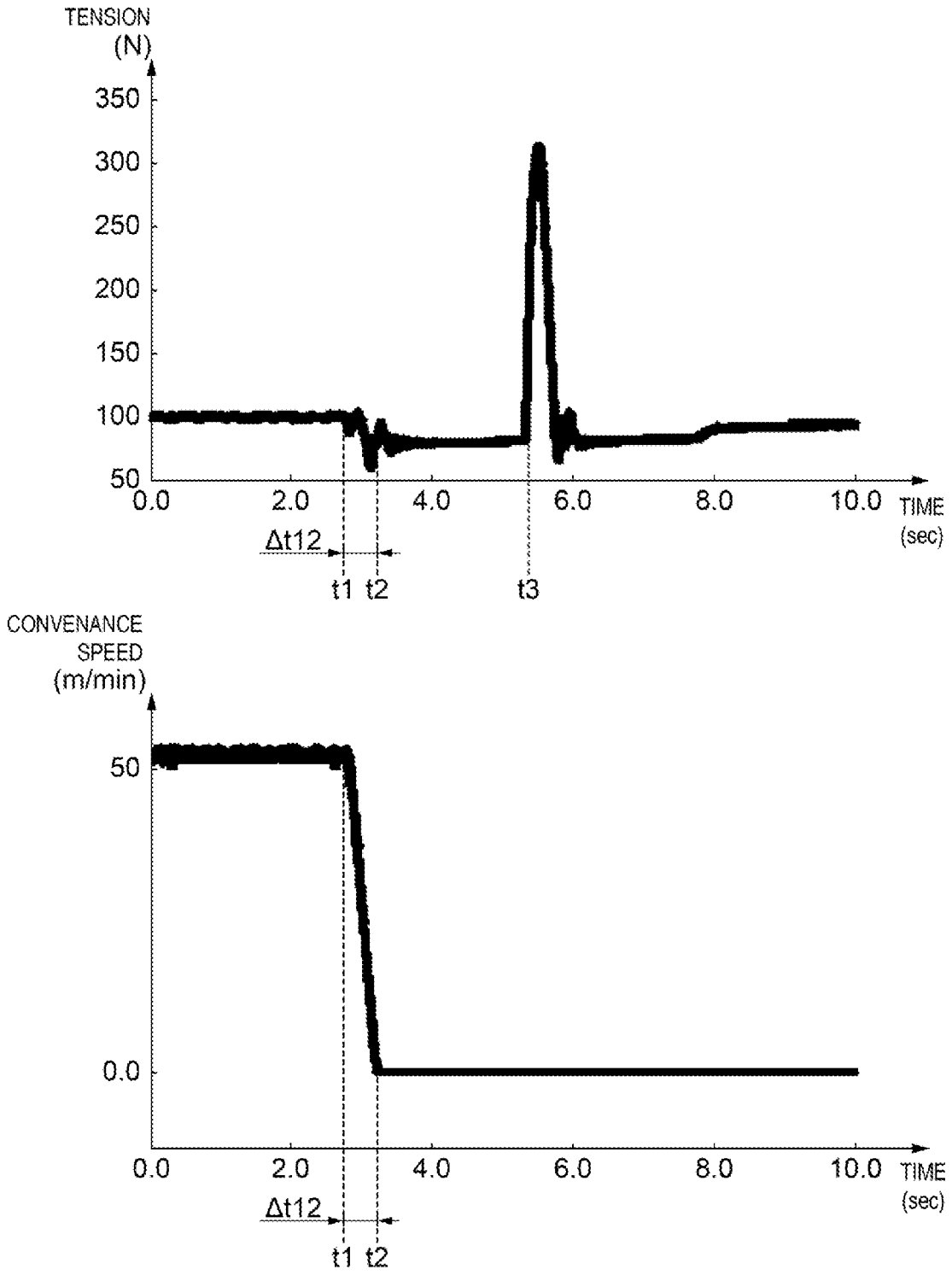
FIG. 3 is a diagram illustrating a change of a tension at the time of an emergency stop in a printer using related-art tension control.

FIG. 3 is a diagram illustrating a change of a tension at the time of an emergency stop in a printer using related-art tension control. Further, FIG. 3 is a diagram illustrating a result of a test conducted by the inventors.

Note that an upper part of FIG. 3 illustrates a time change of a tension imposed on the base material S, and a lower part illustrates a time change of a conveyance speed of the base material S. Note that the conveyance speed is a speed of the front drive roller 31 that is driven to rotate by the front drive motor M31.

The upper part of FIG. 3 illustrates a case with the conveyance speed higher than that in the related art, and the tension control indicates a change of a tension with adaptation of the related-art control. In detail, FIG. 3 illustrates a change of a tension with adaptation of the related control as the tension control in a case where the related-art conveyance speed (printing speed) at, for example, 7.6 m/min, is increased to 50 m/min.

Further, when an emergency stop is performed with the conveyance speed higher than that in the related art, it is required to stop the base material S so that a conveyance distance before a foreign object is convened to the positions of the printing heads 51 is equivalent to a conveyance direction to that in the related art (before increase of the speed). Thus, at the time of an emergency stop, it is required to increase deceleration more than that in the related art. In other words, at the time of an emergency stop, it is required to perform stopping with acceleration higher than that in the related art. As illustrated in the lower part of FIG. 3, in the test, an emergency stop of the conveyance operation is started at a time t1, and a conveyance speed of the base material S is at 0 m/min (conveyance stop) at the time t2. In this case, a deceleration time Δt12 required for an emergency stop is shorter than that in the related art, and hence deceleration is increased.

As described above, in a case where the conveyance operation is stopped in emergency, when a predetermined tension (approximately 100N in FIG. 3) is maintained as shown in the upper part of FIG. 3, the tension fluctuates once between the time t1 and the time t2 (during the deceleration time period Δt12). Further, at a time t3 when a several seconds passes after the conveyance speed is at 0 m/min (in the exemplary embodiment, approximately two seconds later), a sudden fluctuation of the tension (sudden rise of the tension) is caused. After that, the tension is controlled to return to the predetermined tension. Note that during the sudden fluctuation of the tension, as in the upper part of FIG. 3, the tension is changed from 100N to 300N. From this, it can be understood that the predetermined tension rises approximately three times.

In a case where the conveyance operation is stopped in emergency, when the feed motor M20 being a second motor for controlling the tension, the rear drive motor M32, and the winding motor M40 respectively performs control of the tension imposed on the base material S similarly to the related art, the motors are to rotate reversely to loosen the increased tension. Further, when slack is caused, the motors are to perform winding to eliminate the slack. Moreover, at the time of emergency stop, the stop is performed with acceleration higher than that in the related art so that the stop is performed with the same distance as that in the related art. With this, a motion due to the tension control described above stands out, which causes the tension to fluctuate suddenly. FIG. 3 is a diagram illustrating the result.

As described above, when a sudden tension fluctuation is caused at the time of emergency stop, for example, a defect is caused to the steering mechanism 25. The steering mechanism 25 is obtained by forming the feeding shaft 20, the conveying shaft 24, and the tension roller 22 as an integrated block through use of a fixing member (not shown), and is incorporated in the printer 1. In this block, with the fixing member as a reference, the feeding shaft 20 and the tension roller 22 are subjected to alignment adjustment by screw fastening to be fixed. When a sudden tension fluctuation is caused at the time of emergency stop, a force stronger than a fastening force of the screw fastening part is imposed on the steering mechanism 25, which deviates the alignment. When the alignment is deviated, the steering mechanism 25 is not operated normally. Thus, conveyance accuracy of the base material S is unstable, and a defect such as degradation of printing accuracy is caused.

Figure 4:
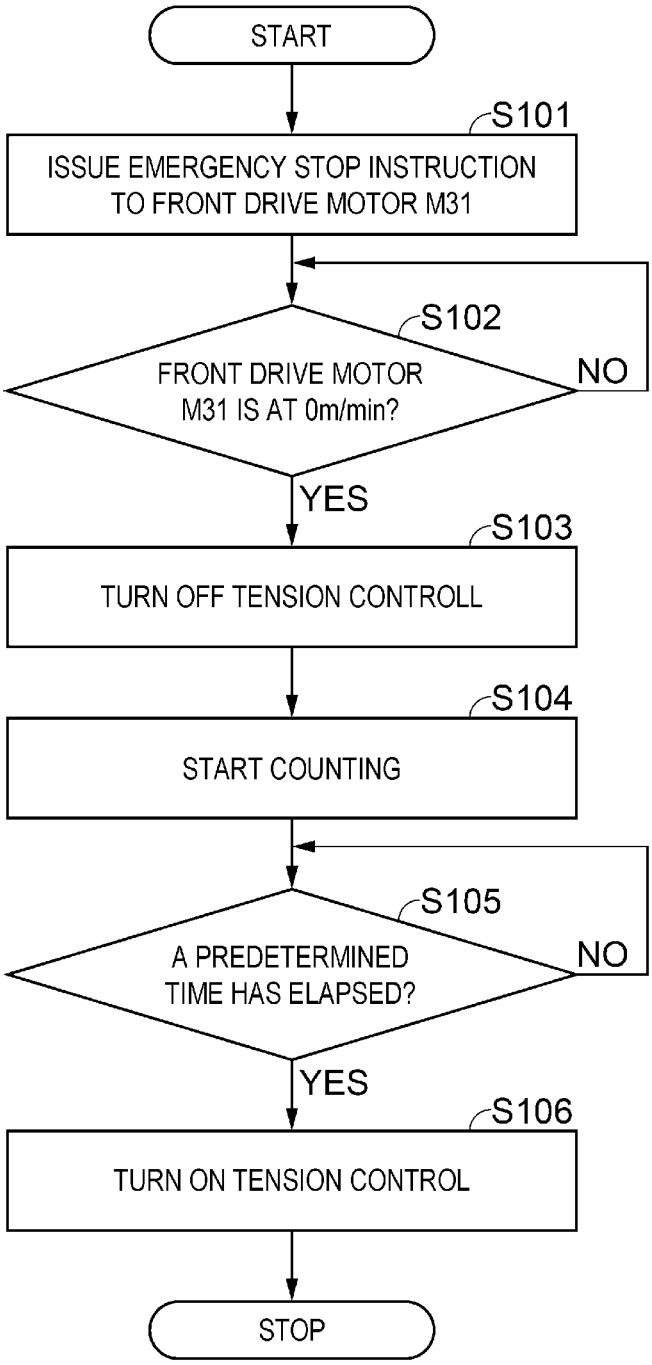
FIG. 4 is a flowchart illustrating one example of control at the time of an emergency stop of in the printer according to the exemplary embodiment.
Figure 5:
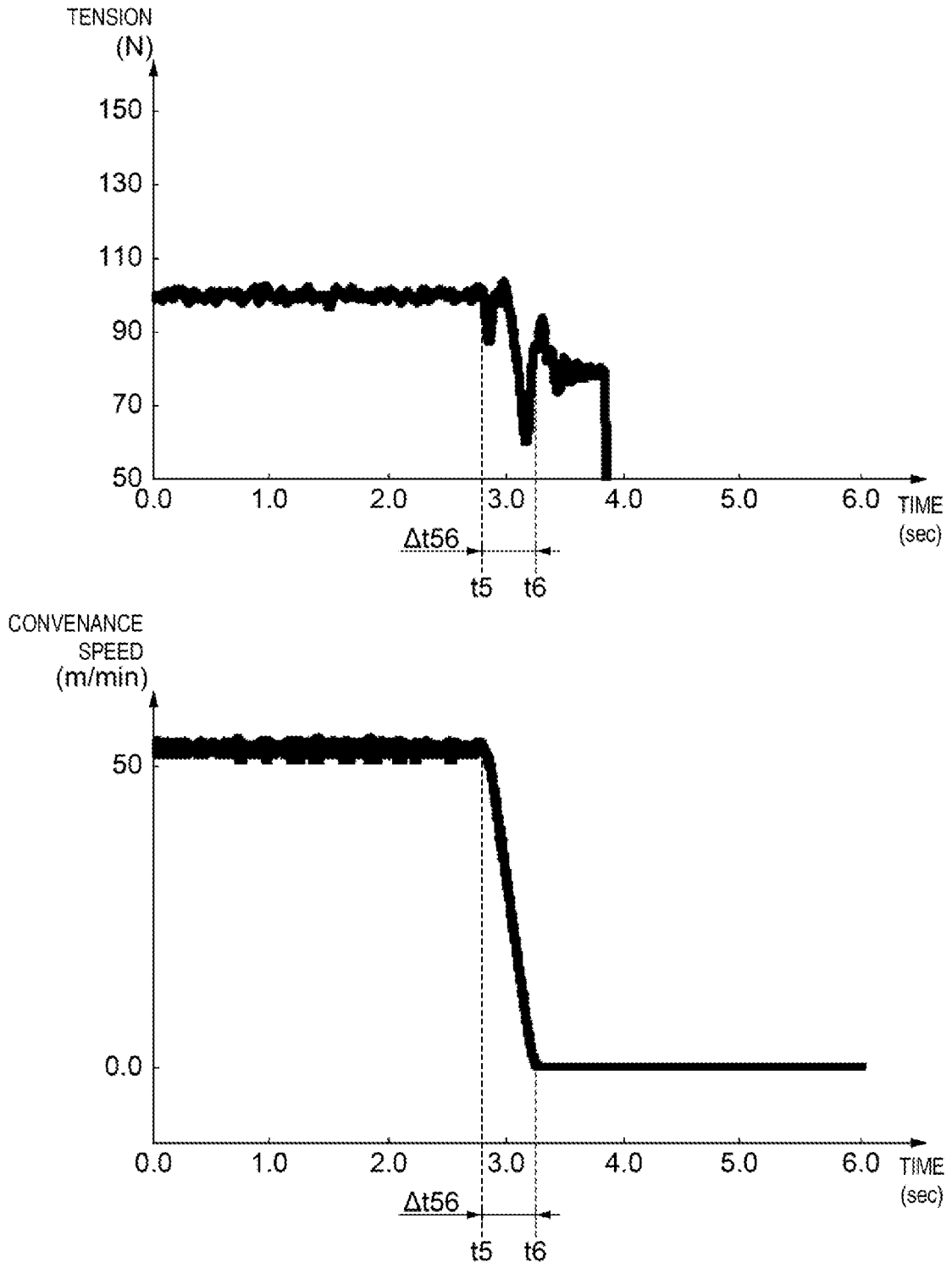
FIG. 5 is a diagram illustrating a change of a tension at the time of an emergency stop in the printer according to the exemplary embodiment.

FIG. 4 is a flowchart illustrating one example of control at the time of an emergency stop of in the printer 1 according to the exemplary embodiment. FIG. 5 is a diagram illustrating a change of a tension at the time of an emergency stop in the printer 1 according to the exemplary embodiment. Note that FIG. 5 is a diagram illustrating a result of a test conducted by the inventors.

An upper part of FIG. 5 illustrates a time change of a tension imposed on the base material S, and a lower part illustrates a time change of a conveyance speed of the base material S. Note that the conveyance speed is a speed of the front drive roller 31. Further, the upper part of FIG. 5 illustrates change of a tension when the control in the exemplary embodiment is adapted in a case where the conveyance speed is at 50 m/min. With reference to FIG. 4 and FIG. 5, control for stopping the conveyance operation in emergency in the exemplary embodiment will be described.

The flowchart in the exemplary embodiment is executed by the control unit 100.

In Step S101, the control unit 100 issues an instruction of an emergency stop to the front drive motor M31. In other words, the control unit 100 issues an instruction of an emergency stop to the front drive motor M31 being a first motor, which has a function of controlling the conveyance speed for conveying the base material S. In Step S102, it is determined whether the front drive motor M31 is at 0 m/min being a conveyance speed for an emergency stop. Note that the determination is performed based on an output of the encode of the front drive motor M31.

When it is determined that the conveyance speed of the front drive motor M31 is at 0 m/min in Step S102 ("YES" in Step S102), the process proceeds to Step S103. In contrast, when it is not determined that the conveyance speed of the front drive motor M31 is at 0 m/min in the Step S102 ("NO" in Step S102), Step S102 is repeated.

In Step S103, the control unit 100 stops the tension control performed by the feed motor M20, the rear drive motor M32, and the winding motor M40, which are the second motors and have a function of controlling a tension imposed on the base material S (torque control). As described above, the tension control of the second motors having a function of controlling a tension is stopped at the time of an emergency stop, and thus a sudden rise of the tension can be suppressed.

Herein, Step S102 and Step S103 correspond to a tension control stop process in the printing method. Specifically, in the tension control stop process, when the control unit 100 stops the conveyance operation in emergency, the second drive motors (the feed motor M20, the rear drive motor M32, and the winding motor M40) stops control of the tension in a case where the speed of the first drive motor (the front drive motor M31) is equal to or less than a predetermined value (in the exemplary embodiment, 0 m/min).

Note that as illustrated in the lower part of FIG. 5, in the test, an emergency stop of the conveyance operation is started at a time t5, and a conveyance speed of the base material S is at 0 m/min (conveyance stop) at the time t6. In this case, a deceleration time period Δt56 required for an emergency stop is shorter than that in the related art with the conveyance speed of 7.6 m/min, and hence deceleration is increased.

As described above, in a case where the conveyance operation is stopped in emergency, when a predetermined tension (approximately 100N in FIG. 5) is maintained as shown in the upper part of FIG. 5, a tension fluctuation due to decrease of the conveyance speed is caused between the time t5 and the time t6 (the deceleration time period Δt56). Note that the fluctuation in this case is a fluctuation by 100N or less.

However, when the conveyance speed is at 0 m/min (conveyance stop), control performed by the second drive motors having a function of controlling a torque is stopped. With this, before causing a sudden tension fluctuation due to slack or tension under a state of performing the related-art tension control (see FIG. 3), control performed by the second drive motors is stopped. Thus, a sudden rise of the tension can be prevented, and a tension fluctuation can be suppressed to a minimum degree. With such operation, even when the deceleration time period Δt56 required for an emergency stop is shorter, and deceleration is increased as compared to the related art, a sudden tension fluctuation in a case where the conveyance operation is stopped in emergency can be suppressed.

Referring back to the flowchart of FIG. 4, in Step S103, the control unit 100 stops the tension control performed by the feed motor M20, the rear drive motor M32, and the winding motor M40, which are the second motors and have a function of controlling a torque (turns off the tension control). After that, the process proceeds to Step S104. In Step S104, in order to count an elapsed time from the stop of the tension control, the control unit 100 starts measurement with a timer.

In Step S105, it is determined whether a measurement value is equal to or more than a predetermined measurement value, that is, whether a predetermined time period (for example, 180 seconds) has elapsed from the stop operation of the drive motors having a function of controlling a torque (tension control). When the measurement value is equal to or more than the predetermined measurement value ("YES" in Step S105), the process proceeds to Step S106. In contrast, when the measurement value is less than the predetermined measurement value ("NO" in Step S105), Step S105 is repeated.

In Step S106, the control unit 100 starts the tension control performed by the feed motor M20, the rear drive motor M32, and the winding motor M40, which are the second motors and have a function of controlling a torque, (turns on the tension control). The control unit 100 drives the feed motor M20, the rear drive motor M32, and the winding motor M40 to start the tension control. With this, in the exemplary embodiment, the tensions Ta, Tb. and Tc are adjusted to the standby tensions Ta2, Tb2, and Tc2, respectively.

Here, Step S104, Step S105, and Step S106 correspond to a tension control process in the printing method. Specifically, in the tension control process, when a predetermined time period passes after the control unit 100 stops the conveyance operation in emergency (when the tension control stop process is completed), the tension control performed by the second drive motors (the feed motor M20, the rear drive motor M32, and the winding motor M40) is started.

Note that, when the tensions Ta, Tb. and Tc are adjusted to the standby tensions Ta2, Tb2, and Tc2, respectively, the control unit 100 performs display indicating that a foreign object is required to be removed via a touch panel display or the like. A user recognizes the display, opens an exterior cover (not shown) of the printer 1, and removes a foreign object adhering to the front surface of the base material S. In this case, the tensions are adjusted to the standby tensions Ta2, Tb2, and Tc2, and hence slack of the base material S is prevented. Thus, the foreign object can be removed easily from the base material S.

After the foreign object is removed, a user issues an instruction of starting printing with the input means. With this, the control unit 100 reads, from the storage unit 101, a program for starting a conveyance operation (printing operation) after an emergency stop, and starts the conveyance operation (printing operation) by following the program.

As described above, according to the printer 1 and the printing method of the printer 1 according to the present exemplary embodiment, the following advantages can be achieved.

With the printer 1 according to the exemplary embodiment, in a case where the conveyance operation is stopped in emergency, when the speed of the front drive motor M31 being a first motor, which has a function of controlling the conveyance speed for conveying the base material S is at 0 m/min, the tension control performed by the feed motor M20, the rear drive motor M32, and the winding motor M40, which are the second motors and have a function of controlling a tension imposed on the base material S, is stopped.

With this, at the time of an emergency stop of a conveyance operation, a sudden tension fluctuation can be suppressed. Particularly, at the time of an emergency stop, a sudden rise of the tension can be suppressed. Note that a sudden tension fluctuation can be suppressed, and hence the alignment of the feeding shaft 20 and the tension roller 22 in the steering mechanism 25 is prevented from being deviated. With this, feeding accuracy of the base material S can be secured, and printing accuracy can be maintained.

Further, particularly, in a case where the printing speed (conveyance speed) of the printer 1 is increased, a sudden tension fluctuation can be suppressed at the time of an emergency stop, which is largely effective in maintaining printing quality.

With the printer 1 according to the exemplary embodiment, in a case where the conveyance operation is stopped in emergency, when a predetermined time period passes (in the exemplary embodiment, 180 seconds), the tension control performed by the feed motor M20, the rear drive motor M32, and the winding motor M40, which are the second motors, is started. With this, the tension control is performed, and the base material S is adjusted to have the standby tensions Ta2, Tb2, and Tc2.

With this, in a case where a foreign object is detected and an emergency stop is performed, when a predetermined time period passes, the base material S is adjusted to have the predetermined tension. Thus, slack of the base material S can be prevented, and the foreign object can be removed easily. Further, when the foreign object is removed, the base material S is prevented from moving. Thus, a conveyance operation (printing operation) after removal of the foreign object can be started smoothly.

With the printing method of the printer 1 according to the exemplary embodiment, the control unit 100 performs the tension control stop process. Thus, in a case where the conveyance operation is stopped in emergency, when the speed of the front drive motor M31 being a first motor, which has a function of controlling the conveyance speed for conveying the base material S is at 0 m/min, the tension control performed by the feed motor M20, the rear drive motor M32, and the winding motor M40, which are the second motors and have a function of controlling a tension imposed on the base material S, is stopped.

With this, at the time of an emergency stop of a conveyance operation, a sudden tension fluctuation can be suppressed. Particularly, at the time of an emergency stop, a sudden rise of the tension can be suppressed. Further, a sudden tension fluctuation can be suppressed, and hence a defect of the conveyance mechanism system of the base material S can be suppressed.

Particularly, in a case where the printing speed (conveyance speed) of the printer 1 is increased, a sudden tension fluctuation can be suppressed at the time of an emergency stop, which is largely effective in maintaining printing quality.

With the printing method of the printer 1 according to the exemplary embodiment, the control unit 100 performs the tension control process. Thus, in a case where the tension control stop process is completed (a case where the conveyance operation is stopped in emergency), when the predetermined time period passes, the tension control performed by the feed motor M20, the rear drive motor M32, and the winding motor M40, which are the second motors, is started. With this, the tension control is performed, and the base material S is adjusted to have the standby tensions Ta2, Tb2, and Tc2.

With this, in a case where a foreign object is detected and an emergency stop is performed, when a predetermined time period passes, the base material S is adjusted to have the predetermined tension. Thus, slack of the base material S can be prevented, and the foreign object can be removed easily. Further, when the foreign object is removed, the base material S is prevented from moving. Thus, a conveyance operation (printing operation) after removal of the foreign object can be started smoothly.

Second Exemplary Embodiment

Figure 6:
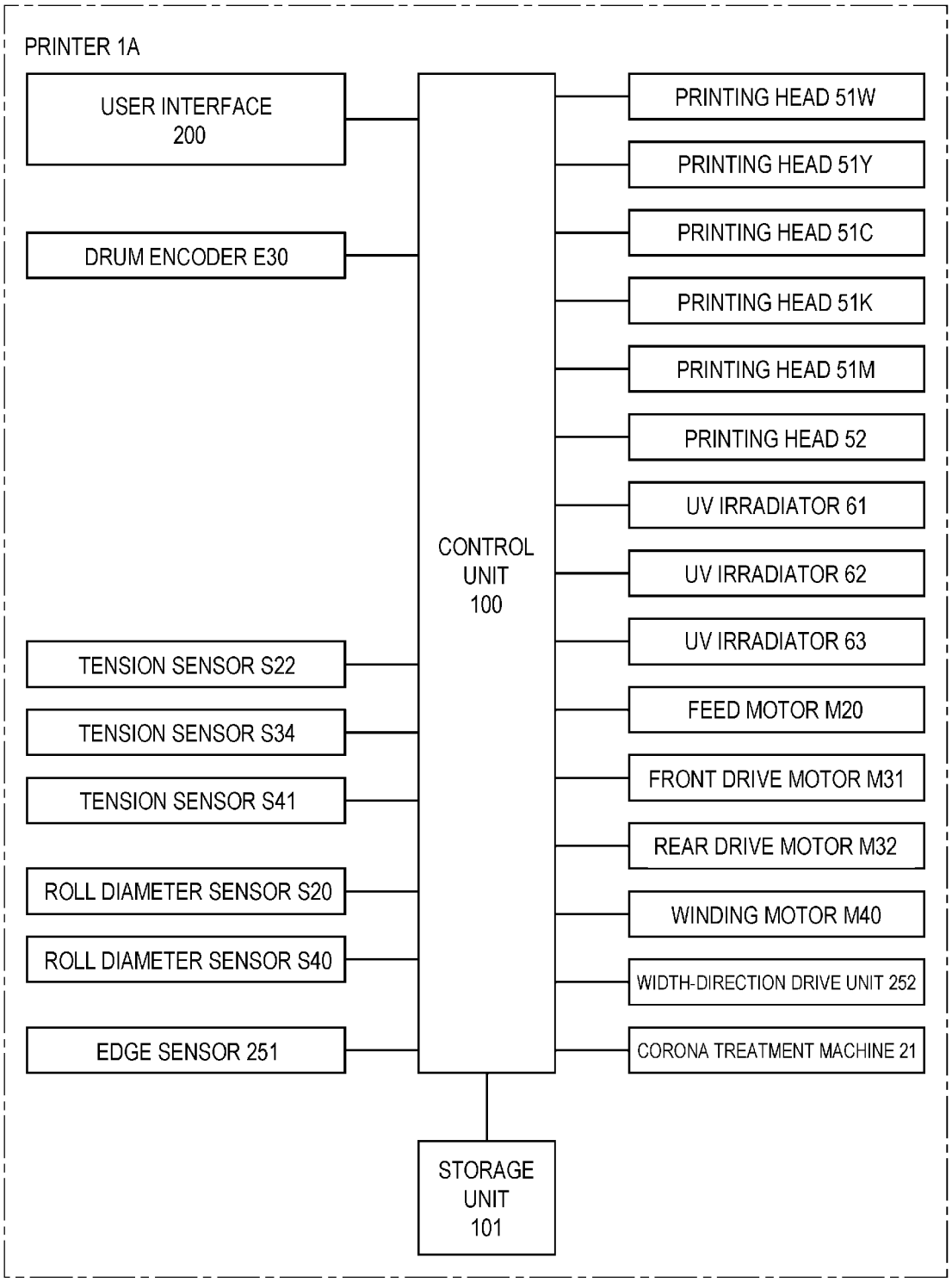
FIG. 6 is a schematic block diagram illustrating an electrical configuration for controlling a printer according to a second exemplary embodiment.

FIG. 6 is a schematic block diagram illustrating an electrical configuration for controlling a printer 1A according to a second exemplary embodiment.

Similarly to the printer 1 according to the first exemplary embodiment, the printer 1A according to the exemplary embodiment is a printing apparatus that conveys the base material S by a roll-to-roll method, and the base material S is wound in a roll shape around the feeding shaft 20 through intermediation of the core pipe 23 that is detachable from the feeding shaft 20. Further, the base material S after completion of printing is wound around the winding shaft 40 via the core pipe 42 that is detachable from the winding shaft 40.

Normally, a roll body having a large roll diameter (obtained by winding the base material S around the core pipe 23 or 42 in a roll shape) is rotated, and thus large inertia is generated. Further, when the inertia generated by the roll body is imposed on the front drive roller 31 via the base material S, responsiveness of the front drive motor M31 at the time of acceleration and deceleration is degraded, and control accuracy is degraded. Thus, in the exemplary embodiment, the inertia due to a rotation of the roll body is considered at the time of an emergency stop, and thus a sudden tension fluctuation is suppressed.

As illustrated in FIG. 6, the printer 1A according to the exemplary embodiment includes a roll diameter sensor S20 provided to the feeding shaft 20 and a roll diameter sensor S40 provided to the winding shaft 40. The other matters are the same as the electrical configuration in the first exemplary embodiment.

Note that the roll diameter sensor S20 detects a roll diameter of a roll body provided to the feeding shaft 20. Similarly, the roll diameter sensor S40 detects a roll diameter of a roll body provided to the winding shaft 40. Further, in the exemplary embodiment, in a case where the conveyance operation is stopped in emergency, when an inertia mass equivalent to the base material S is changed in accordance with the detection values detected by the roll diameter sensors S20 and S40, deceleration of the front drive motor M31 being a first motor is controlled.

When the conveyance operation is stopped in emergency, the printer 1 according to the first exemplary embodiment controls deceleration of the front drive motor M31 with inertia having a fixed value both on the feeding side and the winding side. However, the printer 1A according to the exemplary embodiment performs feedback control with inertia having a variable value in accordance with the rolls diameters on the feeding side and the winding side (weight of the base material S in a roll shape).

Figure 7:
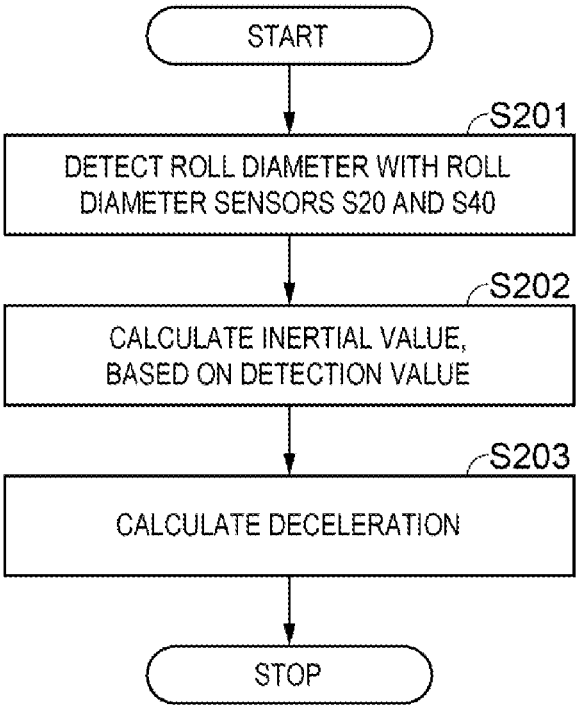
FIG. 7 is a flowchart illustrating one example of control at the time of an emergency stop in the printer according to the exemplary embodiment.

FIG. 7 is a flowchart illustrating one example of control at the time of an emergency stop of in the printer 1A.

Specifically, FIG. 7 is a flowchart for further developing Step S101 in the flowchart (see FIG. 4) described in the first exemplary embodiment.

As illustrated in FIG. 7, in Step S201, the control unit 100 detects the roll diameters with the roll diameter sensors S20 and S40. Note that, in the exemplary embodiment, the control unit 100 uses the detection values detected by the roll diameter sensors S20 and S40 directly before the time of an emergency stop.

In the exemplary embodiment, specifically, a time period required for an emergency stop is set to less than one second. Further, feedback of the inertia is performed every one second. Therefore, the time period required for feedback of the inertia is longer than the time period required for an emergency stop. Thus, in the exemplary embodiment, the value of the inertia directly before the emergency stop is fed back at the time of the emergency stop.

Subsequently, in Step S202, the control unit 100 calculates the value of inertia in accordance of the roll diameters (weight of the base material S in a roll shape), based on the detection value detected in Step S201. Further, in Step S203, the control unit 100 calculates deceleration for driving the front drive motor M31, based on the inertial value calculated in Step S202.

With the deceleration calculated from the flowchart described above, the control unit 100 adjusts a torque of the front drive motor M31 and performs an emergency stop. After that, the process proceeds to Step S102 in the flowchart illustrated in FIG. 4, and a series of operation for an emergency stop is perform.

As described above, with the operations in Step S201, Step S202, and Step S203, at the time of an emergency stop, the inertia value is changed and fed back in accordance with the roll diameters (weight of the base material S in a roll shape) at that time, and thus deceleration of the front drive motor M31 is controlled.

Note that Step S201, Step S202, and Step S203 correspond to an inertia control process in the printing method. Specifically, in the inertia control process, the control unit 100 changes an inertia mass equivalent to the base material S at the time of an emergency stop, based on the detection values of the roll diameter sensors S20 and S40, and controls the first drive motor (the front drive motor M31) at the time of an emergency stop.

As described above, according to the printer 1A and the printing method of the printer 1A according to the present exemplary embodiment, the following advantages can be achieved.

The printer 1A according to the exemplary embodiment includes the roll diameter sensors S20 and S40 that detect the roll diameters of the base material S in a roll shape. Further, the control unit 100 calculates an inertia amount equivalent to the base material S accordance with the detection values of the roll diameter sensors S20 and S40 directly before the emergency stop, and control deceleration of the front drive motor M31 at the time of the emergency stop.

With this, at the time of the emergency stop, the inertia value is fed back in accordance with weight of the base material S in a roll shape (roll diameters) directly before the emergency stop, and deceleration of the front drive motor M31 is controlled. Thus, as compared to the printer 1 according to the first exemplary embodiment, the inertia value can be optimized, and hence a sudden tension rise can further be suppressed efficiently.

With the printing method of the printer 1A according to the exemplary embodiment, the control unit 100 performs the inertia control process. Thus, an inertia mass equivalent to the base material S is determined in accordance with the detection values of the roll diameter sensors S20 and S40, and deceleration of the front drive motor M31 at the time of an emergency stop is controlled.

With this, at the time of the emergency stop, the inertia value is fed back in accordance with weight of the base material S in a roll shape (roll diameters) directly before the emergency stop, and deceleration of the front drive motor M31 is controlled. Thus, as compared to the printer 1 according to the first exemplary embodiment, the inertia value can be optimized, and hence a sudden tension rise can further be suppressed efficiently.

Note that, the present disclosure is not limited to the embodiments described above, and various modifications and improvements can be added to the above-described embodiments. Modifications are described below.

Modification 1

In the printer 1 and the printer 1A according to the exemplary embodiments, in a case where the conveyance speed of the first drive motor (the front drive motor M31), which has a function of controlling the conveyance speed, is at 0 m/min at the time of an emergency stop, the tension control performed by the second drive motors is stopped. However, the present disclosure is not limited thereto. In a case where the conveyance speed of the front drive motor M31 is at a set speed or less (a predetermined value or less), the tension control performed by the second drive motors may be stopped.

Modification 2

In the flow chart of the exemplary embodiment, in Step S105, it is determined whether a predetermined time period (in the exemplary embodiment, 180 seconds) passes from the stop operation of the front drive motor M31 having a function of controlling a torque. However, the predetermined time period may be freely changed.

Modification 3

In the printer 1A according to the exemplary embodiment, the time period required for an emergency stop is less than one second, and the feedback of inertia is performed every one second. Therefore, the time period required for feedback of the inertia is longer than the time period required for an emergency stop. Thus, the value of the inertia directly before the emergency stop is fed back at the time of the emergency stop. However, the present disclosure is not limited thereto. In a case where the time period required for feedback of the inertia can be shorter than the time period required for an emergency stop, deceleration of the front drive motor M31 can be adjusted by switching the inertia value during the process of the emergency stop in a stepwise manner or a smooth manner. With this, a tension rise can further be suppressed efficiently.

Contents derived from the exemplary embodiments and the modifications that are described above are described below.

A printing apparatus according to the present application configured to convey a base material by a roll-to-roll method and perform feedback control to a tension imposed on the base material, the printing apparatus includes a control unit, a first drive motor configured to control a conveyance speed for conveying the base material, and a second drive motor configured to control the tension imposed on the base material, wherein, in a case where a conveyance operation for conveying the base material is stopped in emergency, when a speed of the first drive motor is less than a predetermined value, the control unit stops control of the tension performed by the second drive motor.

With this configuration, in a case where the conveyance operation is stopped in emergency, when the speed of the first drive motor having a function of controlling the conveyance speed for conveying the base material is predetermined value or less, the tension control performed by the second drive motor having a function of controlling a tension imposed on the base material is stopped. Thus, at the time of an emergency stop, a sudden tension fluctuation can be suppressed. Particularly, at the time of an emergency stop, a sudden rise of the tension can be suppressed.

Further, a sudden tension fluctuation can be suppressed, and hence a defect of the conveyance mechanism system of the base material can be suppressed.

Particularly, in a case where the printing speed (conveyance speed) of the printing apparatus is increased, a sudden tension fluctuation can be suppressed at the time of an emergency stop, which is largely effective in maintaining printing quality.

In the printing apparatus described above, in a case where the conveyance operation is stopped in emergency, when a predetermined time period passes, the control unit may start control of the tension performed by the second drive motor.

With this configuration, in a case where the conveyance operation is stopped in emergency, when a predetermined time period passes, the tension control performed by the second drive motor is started. Thus, the base material is adjusted to have a predetermined tension. With this, slack of the base material is prevented, and the foreign object can be removed easily. Further, when the foreign object is removed, the base material is prevented from moving. Thus, a printing operation after removal of the foreign object can be started smoothly.

The printing apparatus described above may further include a roll diameter sensor configured to detect a roll diameter of the base material in a roll shape, and the control unit may change an inertia mass equivalent to the base material in accordance with a detection value of the roll diameter sensor, and control the first drive motor at the time of an emergency stop.

With this configuration, an inertia mass equivalent to the base material is changed in accordance with the detection value of the roll diameter sensor at the time of an emergency stop, and the first drive motor at the time of an emergency stop is controlled. Thus, with the optimized inertia value, deceleration of the first drive motor having a function of controlling the conveyance speed for conveying the base material can be controlled, and a sudden tension rise can further be suppressed efficiently.

A printing method according to the present application is a printing method of a printing apparatus being configured to convey a base material by a roll-to-roll method and perform feedback control to a tension imposed on the base material and including a control unit, a first drive motor configured to control a conveyance speed for conveying the base material, and a second drive motor configured to control the tension imposed on the base material. The printing method includes stopping control of the tension performed by the second drive motor in a case where a conveyance operation for conveying the base material is stopped in emergency, when a speed of the first drive motor is less than a predetermined value.

With this method, the control unit performs the tension control stop process. In a case where the conveyance operation is stopped in emergency, when the speed of the first drive motor is the predetermined value or less, the tension control performed by the second drive motor is stopped. Thus, at the time of an emergency stop, a sudden tension fluctuation can be suppressed. Particularly, at the time of an emergency stop, a sudden rise of the tension can be suppressed.

Further, a sudden tension fluctuation can be suppressed, and hence a defect of the conveyance mechanism system of the base material can be suppressed.

Particularly, in a case where the printing speed (conveyance speed) of the printing apparatus is increased, a sudden tension fluctuation can be suppressed at the time of an emergency stop, which is largely effective in maintaining printing quality.

In the printing method described above, after stopping control the control, the control unit may start control of the tension performed by the second drive motor when a predetermined time period passes.

With this method, the control unit performs the tension control process, in a case where the tension control stop process is completed, when a predetermined time period passes, the tension control performed by the second drive motor is started. Thus, the base material is adjusted to a predetermined tension. With this, slack of the base material can be prevented, and the foreign object can be removed easily. Further, when the foreign object is removed, the base material is prevented from moving. Thus, a printing operation after removal of the foreign object can be started smoothly.

In the printing method described above, the printing apparatus described above may further include a roll diameter sensor configured to detect a roll diameter of the base material in a roll shape, and the control unit may change an inertia mass equivalent to the base material in accordance with a detection value of the roll diameter sensor, and control the first drive motor at the time of an emergency stop.

With this method, the control unit performs the inertia control, and hence an inertia mass equivalent to the base material is changed in accordance with the detection value of the roll diameter sensor at the time of an emergency stop, and the first drive motor at the time of an emergency stop is controlled. Thus, with the optimized inertia value, deceleration of the first drive motor having a function of controlling the conveyance speed for conveying the base material can be controlled, and a sudden tension rise can further be suppressed efficiently.

What is claimed is:

1. A printing apparatus in which a base material is conveyed by a roll-to-roll method and feedback control is performed on a tension imposed on the base material, the printing apparatus comprising:

a control unit;

a first drive motor configured to control a speed of conveyance of conveying the base material; and a second drive motor configured to control the tension imposed on the base material, wherein in response to determining that an emergency stop of a conveyance operation is to be performed, the control unit is configured to:

cause the first drive motor to stop; and when a speed of the first drive motor is at a predetermined value or less, cause the second drive motor to stop controlling the tension imposed on the base material.

2. The printing apparatus according to claim 1, wherein when the conveyance operation is stopped, the control unit starts the tension control performed by the second drive motor after a passage of a predetermined time period.

3. The printing apparatus according to claim 1, comprising a roll diameter sensor configured to detect a roll diameter of the base material wound in a roll shape, wherein the control unit varies an inertia of the base material in accordance with a detection value of the roll diameter sensor, and controls the first drive motor when the conveyance operation is stopped based on the detection of a foreign object.

4. A printing method of a printing apparatus in which a base material is conveyed by a roll-to-roll method and feedback control is performed on a tension imposed on the base material, and which includes a control unit, a first drive motor configured to control a speed of conveyance of conveying the base material, and a second drive motor configured to control the tension imposed on the base material, the printing method comprising:

determining that an emergency stop of a conveyance operation for conveying the base material is to be performed;

stopping, by the control unit, the first drive motor;

determining, by the control unit, that a speed of the first drive motor is at a predetermined value or less;

stopping, by the control unit, the second drive motor for controlling the tension imposed on the base material.

5. The printing method according to claim 4, comprising a tension control step for, after completing tension control stopping step, starting the tension control performed by the second drive motor after a passage of a predetermined time period.

6. The printing method according to claim 4, wherein a roll diameter sensor configured to detect a roll diameter of the base material wound in a roll shape is provided, the method comprising an inertia control step for, by the control unit, varying an inertia of the base material in accordance with a detection value of the roll diameter sensor, and controlling the first drive motor when the conveyance operation is stopped based on the detection of a foreign object.

* * * * *